United States Patent [19]

Vandepol

[11] Patent Number: 4,860,739

[45] Date of Patent: Aug. 29, 1989

[54] SNORKEL

[75] Inventor: Herbert D. Vandepol, North Palm Beach, Fla.

[73] Assignee: Wenoka Seastyle, West Palm Beach, Fla.

[21] Appl. No.: 202,407

[22] Filed: Jun. 6, 1988

[51] Int. Cl.[4] ..... B63C 11/16; B63C 11/18

[52] U.S. Cl. ..... 128/201.11; 128/205.24

[58] Field of Search ..... 128/201.11, 201.27, 128/207.12, 207.16, 200.24, 200.29

[56] References Cited

U.S. PATENT DOCUMENTS

| | | | |
|---|---|---|---|
| 2,317,236 | 4/1943 | Wilen et al. | 128/201.11 |
| 3,860,042 | 1/1975 | Green | 128/201.11 |
| 4,610,246 | 9/1986 | Delphia | 128/205.24 |
| 4,655,212 | 4/1987 | Delphia | 128/201.11 |

FOREIGN PATENT DOCUMENTS

| | | | |
|---|---|---|---|
| 0312092 | 6/1969 | Sweden | 128/201.11 |

OTHER PUBLICATIONS

"A Real Blast!", Wenoka® Sea Style®, Apr., 1988, from *Skin Diver* Magazine.

*Primary Examiner*—David A. Wiecking
*Assistant Examiner*—Kimberly L. Asher
*Attorney, Agent, or Firm*—Wolf, Greenfield & Sacks

[57] ABSTRACT

A diving snorkel is provided comprising a mouthpiece assembly attached to a breathing tube. First and second purge valves are located in a side wall of the mouthpiece assembly. A partition is disposed in the side wall, between the two purge valves, so as to partially divide the breathing chamber into first and second sections. The first section includes the first purge valve which lies directly in the path of air exhaled from the diver's mouth. The second section contains the second purge valve which is blocked from the direct flow path of the air from the diver's mouth by the partition but does receive some air which flows around the end of the partition into the second section. The partition is inclined so as to direct water to flow, by force of gravity, from the first section to the second section. Another surface directs water within the second section towards the second purge valve.

13 Claims, 1 Drawing Sheet

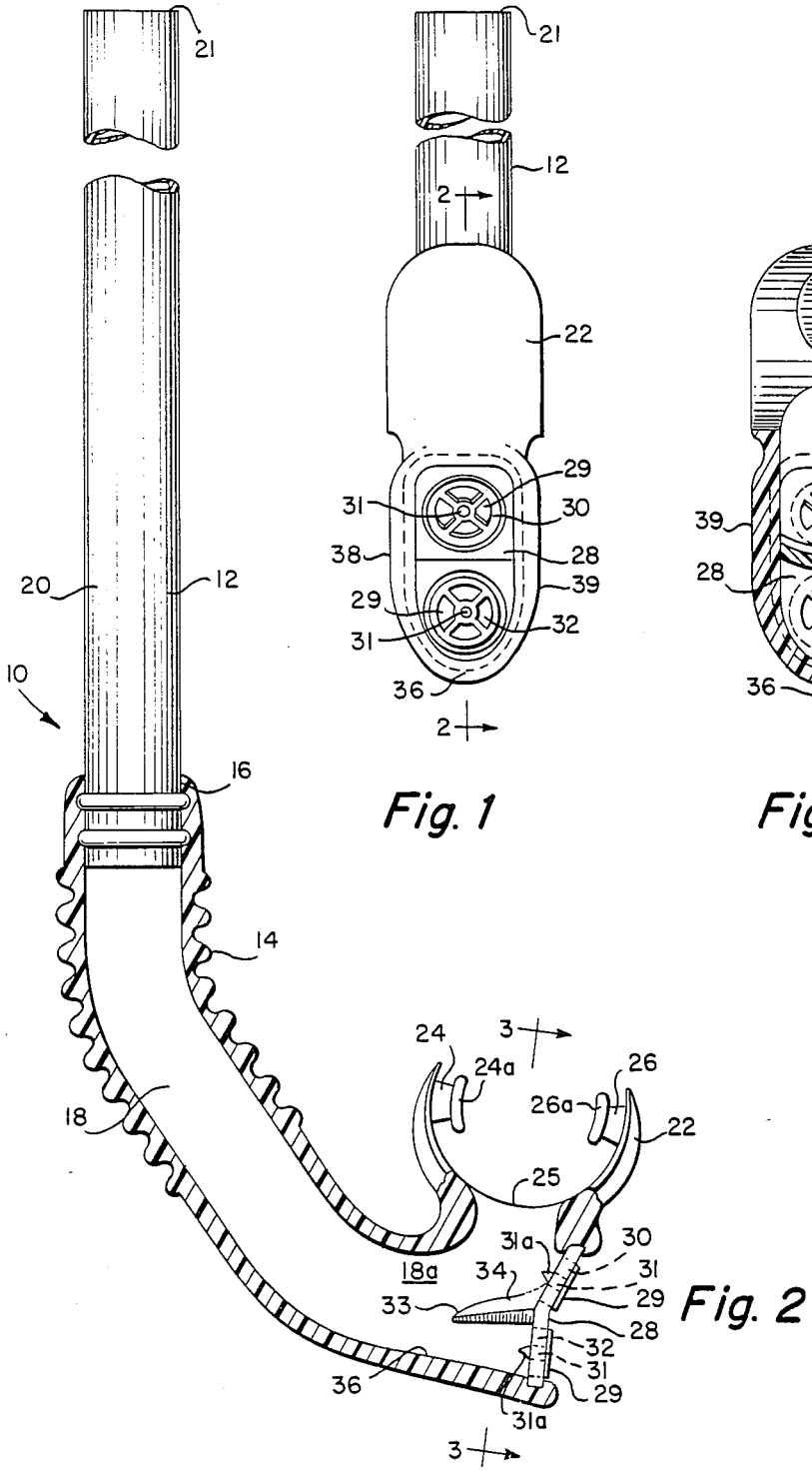
Fig. 1
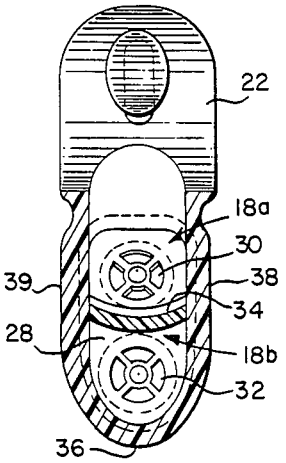
Fig. 3
Fig. 2

SNORKEL

FIELD OF THE INVENTION

The invention relates to underwater breathing apparatus for use in combination with either scuba diving equipment or snorkeling equipment.

BACKGROUND OF THE INVENTION

Professional type snorkels for use with scuba diving equipment or snorkeling are generally of a very basic design comprising a breathing tube which is attached to a rubber or silicone mouthpiece assembly. The purpose of a snorkel is to permit the user (hereinafter referred to as diver) to keep his face, including his eyes, mouth and nose, under the surface of the water while allowing him to continue breathing through the snorkel apparatus. The diver places one end of the snorkel breathing apparatus in his mouth and positions the snorkel so that the breathing tube extends around the side of his head and protrudes above the surface of the water.

Unfortunately, snorkel apparatus continuously fill with water, either partially or completely, due to a variety of occurrences. First, during normal surface swimming, the upper end of the breathing tube extends only a few inches above the surface of the water. Splashing at the surface of the water, either due to waves or the swimming motions of the diver himself, causes water to lap over the open end of the breathing tube and fall into the snorkel. Water may also enter the snorkel when the diver turns his head to the side causing the open end of the snorkel to either partially or completely submerge for an instant. Water also flows into the breathing passage of the snorkel due to leakage around the seal between the diver's mouth and the mouthpiece. Another way in which water enters into the breathing passage of the snorkel is when the diver deliberately submerges his entire head including the snorkel in order to swim downward into the water. When the diver resurfaces the entire snorkel breathing passage will be completely filled with water.

When the snorkel becomes either partially or completely filled with water, the diver must clear out the water in order to resume normal breathing. Typically, the quickest and easiest way to clear the breathing passage is to strongly and quickly exhale a burst of air through the snorkel so as to force the water out of the upper opening. The first burst of air will usually clear out enough water so that the diver can breathe through the snorkel. However, some water will usually remain in the snorkel making breathing difficult for the diver. Typically, the diver must force two or three bursts of air through the breathing passage before all the water is cleared. Alternatively, many divers cannot produce the force necessary to completely clear the snorkel of water and therefore must lift their heads completely above the water and remove the snorkel to drain it. This operation is extremely time consuming, tiring and cumbersome since the diver must tread water in order to keep his head above water during the operation. In addition, it is frequently undesireable for the diver to lift his head out of the water because this would cause the diver to lose sight of something he is observing beneath the water.

In order to reduce the problems of clearing the snorkel or breathing passage of water, some snorkels are provided with a single purge valve placed in various positions to evacuate water. Typically, the purge valve is placed at the end of a separate chamber from the main breathing passageway, somewhere on the apparatus so that it will remain underwater during normal snorkeling. The separate chamber is connected to the main chamber at the end opposite the purge valve.

When the diver resurfaces after completely submerging his head, the breathing passage is completely filled with water. The water in the breathing tube will automatically drain through the purge valve until the water level in the tube is equal to the surface of the water. Although this decreases the amount of water which the diver must clear from the tube, the diver must still clear the breathing passage through the upper opening of the tube with a blast of air from his lungs. With these types of snorkels, when the diver exhales into the tube, some water will evacuate through the purge valve and some water will evacuate through the upper opening. A fairly strong burst of air is still required.

It is an object of the present invention to provide an improved snorkel.

It is another object of the present invention to provide a snorkel with improved means for purging the breathing chamber of water.

It is a further object of the invention to provide an improved snorkel wherein up to 100% of the water in the breathing passage is evacuated through purge valves adjacent to the diver's mouth, thereby reducing the force needed to clear the snorkel of water.

SUMMARY OF THE INVENTION

The snorkel of the present invention includes a mouthpiece assembly attached to a breathing tube. The mouth piece assembly comprises two purge valves disposed one above the other, adjacent to an opening for engaging the mouth of the diver. The purge valves are separated by a partition which serves two purposes. First, the partition divides the breathing chamber in the mouthpiece into two separate sections, an upper section including the upper purge valve which is in the direct flow path of the diver's breathing and a lower section including the lower purge valve which only receives air indirectly from the diver's breath. Second, the partition is inclined downwardly into the chamber in order to direct water, by the force of gravity, from the upper section to the lower section. The lower section has a bottom surface which is inclined towards the lower purge valve thereby causing water to flow, by force of gravity, towards the lower purge valve.

When the snorkel is partially filled with water, the water will drain to the lower section of the breathing chamber thereby creating two beneficial results. First, the water will be outside of the direct flow path of the diver's breath and therefore will not disturb the diver's breathing. Second, since the purge value is adjacent the diver's mouth (even though not in the direct path of air), the force of a natural exhale by the diver will cause the water to evacuate through the lower purge valve.

When the snorkel air passageway becomes completely filled with water, the water will automatically drain through both purge valves until the water level in the breathing tube is equal to the water surface. The remaining water can be evacuated by the diver exhaling. The divers exhale, however, need not be as strong as was required by the prior art snorkels because both valves are very close to the diver's mouth and the upper purge valve is in the direct path of the diver's exhaled breath.

The design of the snorkel of the present invention allows for up to 100% of the water in the air passageway to be evacuated through the purge valves. Much less force is needed to evacuate water through the purge valves than would be required to force air 14 to 15 inches up through the breathing tube and out of the upper opening.

BRIEF DESCRIPTION OF THE DRAWINGS

The invention will be better understood when the following detailed description is read in conjunction with the drawings of which:

FIG. 1 is a view of a snorkel and mouth piece embodying the present invention taken from the mouthpiece side of the snorkel, FIG. 2 is a cross sectional view taken on the line 2—2 of FIG. 1, and FIG. 3 is a cross section taken along the line 3—3 of FIG. 2.

DETAILED DESCRIPTION OF THE PREFERRED EMBODIMENT

The snorkel of the present invention consists of a breathing tube 12 and a mouthpiece assembly 14. The breathing tube 12 fits snugly within the mouthpiece assembly 14 at end 16 to provide a water-tight seal. The inner chamber 18 of the mouthpiece assembly and the inside passage 20 of the breathing tube 12 form the breathing passageway from the diver's mouth to the upper opening 21 of the breathing tube 12. The opening 22 for engaging the mouth of the diver has a semi-circular shape with two conventionally shaped grips formed of tabs 24 and 26 so that a diver can hold the snorkel in his mouth by biting down on the tabs 24 and 26 between flanges 24A and 26A and the inner wall 25 of the mouthpiece assembly.

The outer side wall 28 of the mouthpiece assembly is provided with two purge valves 30 and 32. The valves are uni-directional such that when the pressure on the outside of the snorkel is greater than the pressure inside the chamber 18 the valves remain closed. When the pressure on the inside of the snorkel exceeds the pressure on the outside, the valves open to allow air and water to exit from the snorkel. These valves are made of a flexible rubber diaphragm 29 with an axially extending integrally formed pin 31. Inwardly extending flanges 33 (FIG. 2) form a central opening sized and shaped to engage pin 31 which is secured by a barb 31A at the end of the pin.

A partition 34 is integrally molded within the mouthpiece assembly. It extends from the inner surface of side wall 28 between the upper valve 30 and the lower valve 32 into the chamber 18, dividing it into two sections **18*a* and 18*b* that are in fluid connection. The partition 34 extends completely across the chamber from the front wall 38 to the back wall 39. The partition 34 is curved from front wall 38 to back wall 39. Preferably, the partition 34 is tapered at end 33. The partition 34 divides the chamber 18 into two sections, 18A providing a funnel-like air passage adjacent the opening for the diver's mouth 22, and 18B forming a water trap below the section 18A**.

The upper half of wall 28 above partition 34 has its inner surface in a plane at a 20° to 25° angle from the plane in which the inner surface of the lower half of wall 28 is positioned. Additionally the upper surface of partition 34 is inclined downwardly from the inner surface of the lower half of side wall 28 at an angle of about 70° to 75° into the chamber so that water entering the snorkel through the mouthpiece 22 when the snorkel is upright will roll down the partition 34 into the lower section 18B due to the force of gravity. The partition 34 further serves to block the lower valve 32 from the direct path of air exhaled from the diver's mouth.

Since the upper valve 30 is positioned on the upper half of wall 28, it lies in a plane that is angled about 22° to 25° towards the opening 22 so that the force of exhaled air from the mouth of the diver more directly strikes it. This angle will also minimize the likelihood of water collecting behind the valve. The bottom surface 36 of the mouthpiece assembly 14 is flared open toward the lower half of wall 28 to provide an enlarged volume in section 18B. Water entering into the chamber 18, either from the breathing tube or from the mouthpiece flowing down the partition 34, is forced by gravity and the incline of the bottom surface 36 to the lower section 18B and towards the lower valve 32.

Water entering the chamber 18 through the upper opening of the mouthpiece 22, is directed towards section 18B of the chamber and valve 32 by partition 34 and the bottom surface 36. The water in the chamber 18 flows into the lower section 18B where it is not in the direct flow of air from the diver's mouth to the upper opening. This arrangement provides two distinct advantages. First, water in the tube does not interfere with the breathing of the diver since it is spaced from the main breathing channel by partition 34. Second, since the valve 32 is adjacent the diver's mouth, when the diver exhales during normal breathing, enough pressure is created in section 18B of the breathing chamber to open the valve 32 and force the water from the breathing chamber.

When the volume of water in the snorkel exceeds the volume of section 18B and chamber 18A becomes at least partially filled with water, the water in the snorkel will flow out both valves 30 and 32 until the pressure in the breathing chambers 18 and 20 equals the outside pressure, i.e., when the water in the breathing tube 12 drops to the water surface level. If the diver raises his head completely out of the water, all of the water will flow through purge valves 30 and 32. Frequently, however, the diver will not lift his head completely out of the water. In such a case, the breathing chamber will remain filled with a significant amount of water. The diver can exhale a breath of air in order to clear the remaining water from the snorkel. Since water will pass through both valves 30 and 32 the diver need produce a much smaller force with his lungs than if he had to evacuate the entire volume of water through the top opening 21 or through a single valve spaced remote from the main breathing passageway. Since valve 30 is so close to the diver's mouth and is angled to directly and efficiently receive the force from the exhaled air, the amount of force which the diver must produce with his lungs is significantly less than in the prior art snorkels which provide a single purge valve in a separate chamber spaced from the main passageway. If the diver exhales forcefully, some water will evacuate through the upper opening. However, up to 100% of the water can be forced through purge valves 30 and 32 with a relatively firm breath of air.

In this preferred embodiment, both purge valves 30 and 32 and the air passages connecting them to the mouthpiece 22 are all located below the mouthpiece 22 when the snorkel is in its normal use position. Further the distance between the valves and mouthpiece is relatively short and direct.

Having thus described one preferred embodiment of the present invention, it will be apparent to those skilled in the art that various modifications and alterations are possible without departing from the spirit and scope of the invention. The invention is not intended to be limited to the preferred embodiment disclosed above. It is limited in scope only by the following claims.

I claim:

1. A snorkel having a mouthpiece assembly and a breathing tube attached to said mouthpiece assembly, said mouthpiece assembly comprising;

means forming a chamber within said mouthpiece assembly, a mouthpiece connected to said chamber, a pair of purge valves located in said chamber in fluid communication with said mouth piece with both valves below the level of the mouthpiece when the snorkel is in normal use and with one of said purge valves closer to said mouthpiece than the other of said purge valves.

2. A snorkel having a mouthpiece assembly shaped to be engaged by and received in a diver's mouth, said mouthpiece assembly having means forming a chamber integrally connected to one end of a breathing tube, with the other end of the breathing tube remote from said mouthpiece assembly, said chamber forming an air passage from the diver's mouth to said breathing tube, means dividing said chamber into upper and lower sections in fluid connection with one another, said dividing means including a partition for diverting water within said chamber to a location remote from said air passage to the diver's mouth, and;

first and second purge valves located in said upper and lower sections, respectively.

3. A snorkel as set forth in claim 2 wherein said first and second purge valves are formed in a side wall of said mouthpiece assembly, said first purge valve being directly above said second purge valve and said partition disposed on said side wall between said valves.

4. A snorkel as set forth in claim 3 wherein said first purge valve lies primarily in a plane at an angle of about 20° to 25° from the vertical and said second purge valve lies primarily in a plane parallel to the vertical when the snorkel is positioned with the length of the breathing tube vertical.

5. A snorkel as set forth in claim 3 wherein said partition is inclined to direct water away from said side wall.

6. A snorkel having a breathing tube attached to a mouthpiece assembly, said mouthpiece assembly comprising;

a chamber within said mouthpiece assembly, means forming an opening for engagement by the mouth of the diver, first and second purge valve means adapted to open and allow gas and liquid to escape from inside the mouthpiece assembly when the pressure inside the mouthpiece assembly exceeds the pressure outside of the mouthpiece assembly and to close when the outside pressure exceeds the pressure inside the mouthpiece, said first purge valve means disposed above said second purge valve means and both purge valve means disposed adjacent to and below said means forming an opening, a partition disposed between said first and second purge valve means, said partition inclined downwardly from said means forming an opening to direct water to flow, by force of gravity, from the space adjacent said first purge valve means towards the space adjacent said second purge valve means.

7. A snorkel as set forth in claim 6 further comprising a surface adjacent said second purge valve means, said surface inclined to direct water towards said second purge valve means by force of gravity.

8. A snorkel as set forth in claim 6 wherein said first purge valve means is positioned to be in the direct flow of air exhaled from said diver's mouth and said second purge valve means is positioned so that said partition directs said flow of air so that it does not directly strike said second purge valve means.

9. A snorkel having a mouthpiece assembly and a breathing tube attached to said mouthpiece assembly, said mouthpiece assembly comprising;

means forming a chamber within said mouthpiece assembly, a mouthpiece connected to said chamber for engagement with a person's mouth, first and second purge valves located in said chamber and means for diverting at least a portion of air exhaled through said mouthpiece away from said second purge valve and directly towards said first purge valve.

10. A snorkel as set forth in claim 9 having means for diverting water which accumulates in said chamber away from said first purge valve and towards said second purge valve.

11. A snorkel as set forth in claim 10 wherein said means for directing water comprises means dividing said chamber into first and second sections in fluid communication with one another and wherein said first and second purge valves are disposed in said first and second sections, respectively.

12. A snorkel as set forth in claim 11 wherein said dividing means includes a partition for diverting water within said chamber to a location remote from said mouthpiece.

13. A snorkel having a mouthpiece assembly and a breathing tube attached to said mouthpiece assembly, said mouthpiece assembly comprising;

means forming a chamber within said mouthpiece assembly, a mouthpiece connected to said chamber for engagement with a person's mouth, first and second purge valves located in said chamber, means dividing said chamber into first and second sections fluid communication with one another and wherein said first and second purge valves are disposed in said first and second sections, respectively, wherein said first section is located above said second section with said first purge valve substantially within the direct path of air flow and said second purge valve substantially remote from said path of direct air flow.

* * * * *